US006057610A

United States Patent [19]

Nierescher

[11] Patent Number: 6,057,610

[45] Date of Patent: May 2, 2000

[54] LIGHTER PLUG DC OUTLET AND SINGLE AC AND DC PLUG WITH ADAPTER CIRCUIT

[75] Inventor: David S. Nierescher, Newcastle, Wash.

[73] Assignee: SelfCHARGE Inc., Redmond, Wash.

[21] Appl. No.: 09/082,981

[22] Filed: May 21, 1998

Related U.S. Application Data

[60] Provisional application No. 60/047,335, May 21, 1997, and provisional application No. 60/048,888, Jun. 6, 1997.

[51] Int. Cl.[7] ..... H01H 13/703

[52] U.S. Cl. ..... 307/72; 307/10.1; 340/661; 439/170; 439/218; 439/638

[58] Field of Search ..... 307/72, 119, 130, 307/125, 10.1, 140; 340/661; 439/188, 218, 638, 170

[56] References Cited

U.S. PATENT DOCUMENTS 3,967,133 6/1976 Bokern ..... 340/661
4,915,639 4/1990 Cohn et al. ..... 439/188
4,999,752 3/1991 Rogers et al. ..... 439/218
5,516,189 5/1996 Ligeras ..... 297/180.11
5,599,204 2/1997 Glassford ..... 439/638
5,648,712 7/1997 Hahn ..... 439/170

*Primary Examiner*—Albert W. Paladini
*Attorney, Agent, or Firm*—Christensen O'Connor Johnson & Kindness PLLC

[57] ABSTRACT

An adapter plug system connectable to AC and DC sources for powering an electrically powered device. The system includes an adapter power cord for translating AC or DC voltages into a predefined DC voltage and a DC adapter. The adapter power cord also includes an adapter circuit in a case that translates a received voltage into a voltage acceptable for an attached electrically powered device. The adapter power cord includes a switch for automatically or manually setting the adapter circuit to translate AC or DC voltages. The system also includes a DC adapter that inserts into a vehicle lighter outlet for supplying a DC voltage to plug prong receiving ports.

10 Claims, 3 Drawing Sheets

LIGHTER PLUG DC OUTLET AND SINGLE AC AND DC PLUG WITH ADAPTER CIRCUIT

RELATED APPLICATIONS

The benefit of the filing dates of provisional applications Ser. No. 60/047,335, filed on May 21, 1997, and Ser. No. 60/048,888, filed on Jun. 6, 1997, is hereby claimed for this application under 35 U.S.C. §119(e).

FIELD OF THE INVENTION

This invention relates to apparatus for converting an AC or DC power source to a required DC voltage for a battery powered device.

BACKGROUND OF THE INVENTION

Typically, rechargeable battery powered devices, such as cellular phones, exhibit approximately two hours of usefulness prior to requiring recharging of the contained or removable rechargeable batteries. A continuous supply of pre-charged rechargeable batteries must be available in order to maintain continuous use of the device. If a limited number of rechargeable batteries are available, the active use of the device is limited. One can get greater use out of the device by purchasing an power adapting cord. For example, an AC power device with plug inserts into an AC outlet and the device, thereby providing AC voltage to the device. The device includes an adapter circuit for translating that received AC voltage to an acceptable DC voltage for powering the device.

However, automobiles and small boats do not include AC outlets, thereby limiting active device time to what power is left in the batteries. In order to be compatible with the power available in an automobile and small boat the operator must purchase a DC power connector that connects to the DC power supplied through the cigarette lighter receptacle of the vehicle. The devices must include circuitry for translating a DC input received from a DC power device into the DC required for the device. This type of circuitry is common in many battery powered devices or in the DC power device.

Therefore, the user who travels by vehicle much of the time, such as a salesperson, is inconvenienced with having to purchase and always carry an AC and DC power device. As is typical in today's society, the more gadgets one has, the more of a chance one has of losing them. Also, the purchase price of the battery powered device increases because a user who requires the need to adapt to both AC and DC sources is required to purchase separate AC and DC power devices.

The present invention is directed to decreasing the cost and complexity of owning a rechargeable battery powered device.

SUMMARY OF THE INVENTION

In accordance with this invention, an adapter plug system that is connectable to AC and DC sources for powering electrically powered devices is provided. The system includes an adapter power cord for receiving and translating AC or DC voltages into a predefined DC voltage and a DC adapter. The adapter power cord includes an adapter circuit housed in a case that is attachable to an electrically powered device for translating the received voltage into a voltage acceptable for an attached electrically powered device. The adapter power cord includes a plug attached to the case with first and second prongs spaced apart from one another and generally parallel to each other. The plug prongs are electrically coupled to the adapter circuit and are insertable into an electrical power outlet for receiving a voltage. The adapter power cord further includes a switch for setting the adapter circuit to translate either AC or DC voltages received from the electrical power outlet. The system also includes a DC adapter with an outlet portion, wherein the outlet portion resembles a standard two-prong AC outlet with plug prong receiving ports and wherein the DC adapter is insertable into a vehicle lighter outlet for supplying a DC voltage to the adapter circuit when the plug prongs are inserted into the plug prong receiving ports.

In accordance with other aspects of this invention, the switch includes a pressure sensitive button mounted between the plug prongs, and the DC adapter includes a pressure sensitive button activator located on the outlet portion between the plug prong receiving ports for activating the pressure sensitive button when the plug prongs are inserted into the plug prong receiving ports.

In accordance with other aspects of this invention, the switch includes a AC/DC voltage determining circuit for automatically determining the value or type of the received voltage, and the adapter circuit translates the received voltage based on the determination made by the AC/DC voltage determining circuit.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
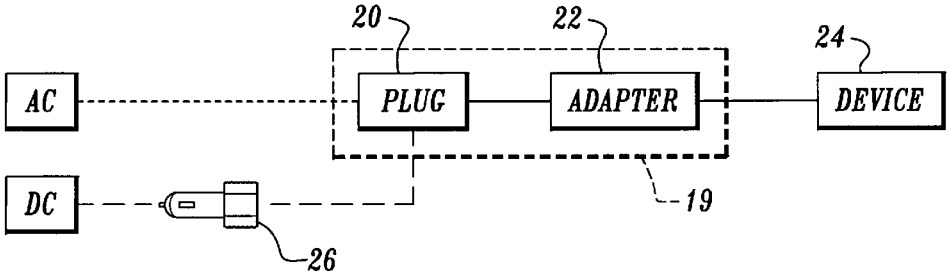
FIG. 1 is a block diagram illustrating the present invention operating with either an AC or DC power source.

FIG. 1 is a high level block diagram that illustrates the ability of a single AC and DC converter to connect to both AC and DC power sources. More specifically, the AC and DC converter 19 includes an AC and DC plug 20 and an adapter circuit 22. The AC and DC plug 20 connects directly to an AC power source, for translating AC power to a rechargeable battery powered device 24, or to a lighter outlet that provides a DC power supply through a lighter plug DC outlet 26, thereby translating DC power for the device 24.

Figure 2A:
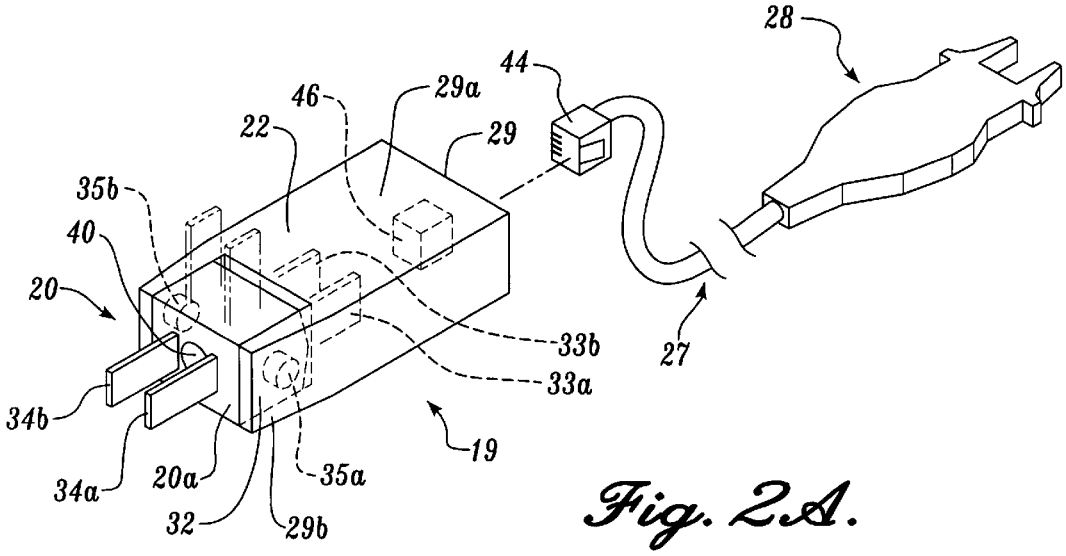
FIGS. 2A and 2B are perspective views of the AC and DC power supply cord.

Referring to FIG. 2A, the AC and DC converter 19 includes an adapter housing 29, with a power output port 46 for receiving an opposing plug head 44 connected to one end of a standard two-wired power cord 27, and a rotatably attached AC and DC plug 20 at the other end of the adapter housing 29. The power cord 27 includes a device-specific connecting piece 28 at its other end. The device-specific connecting piece 28 shown in FIG. 2A is the type operable with a Motorola® flip phone. The adapter housing 29 includes a top portion 29*a* and a bottom portion 29*b*. The top and bottom portions 29*a* and 29*b* include a plug cavity 32 and prong cavities 33*a* and 33*b*. The plug cavity 32 is sized to receive the plug 20. Preferably, top and bottom portions 29*a* and 29*b* are composed of light rigidly formed plastic, but could be composed of any material that allows the adapter housing 29 to be light, durable and inexpensive to construct.

The plug 20 includes a housing 20*a* with two parallel metallic plug prongs 34*a* and 34*b* that extend therefrom. The prongs 34*a* and 34*b* are acceptably long enough to be received by an AC outlet. Plug 20 also includes metallic plug axles 35*a* and 35*b* connected to the prongs 34*a* and 34*b*, respectively, inside housing 20*a*. Preferably, the plug housing 20*a* is composed of a material similar to that used to construct the adapter housing 29. Each plug axle 35*a* and 35*b* extends out opposite sides of housing 20*a*. The sides the axles extend from are orthogonal to the side the plug prongs extend from. The portions of the plug axles that extend out of housing 20*a* are rotatably mounted into opposing plug cavity walls of the adapter housing 29.

The rotatable connection between the plug axles 35*a* and 35*b* and the adapter housing 29 allows the plug to rotate through a number of different operating positions. In a first position, the plug prongs 34*a* and 34*b* are recessed into plug prong cavities 33*a* and 33*b*, respectively, and the surfaces of plug 20 are flush with the outer surfaces of the adapter housing 29. The plug also rotates through three other operational positions: 90°, 180°, and 270° from the first position. In any one of these three operational positions, the plug may be connected to an outlet or power strip cord. However, it can be appreciated by those of ordinary skill in the art, that the plug 20 may be operational between any one of the positions described above and also at reasonable positions less than the 90° and greater than the 270° positions. Therefore, if one were to insert the AC and DC converter 19 into a wall outlet with the plug 20 in approximately the 90° position and the adapter housing 29 is above the outlet, the adapter housing 29 can safely swing through the 180° to approximately the 270° while the prongs maintain an electrical connection to the internal components of the adapter housing 29.

Located within the adapter housing 29 is the adapter circuit 22. Preferably, the adapter circuit 22 is implemented on a circuit board with input and output leads. The input leads connect to axles 35*a* and 35*b* inside the plug housing 29 and the output leads connect to the power output port 46. The adapter circuit 22 includes circuit components for translating both AC and DC signals into multiple DC voltage values. Each generated DC voltage value is assigned and delivered to a single lead within the power output port 46. Since the output port 46 includes multiple leads of various DC voltage values, the plug head 44 must connect to the lead whose voltage corresponds to that required by the battery powered device 24 connected to connecting piece 28. Therefore, if someone has multiple battery powered devices all that is required is a single plug 20 and adapter circuit 22 and a cord 27 unique for each device. For example in FIG. 4, if four leads (1 common ground, 3 different DC values) are present in the output port 46, the plug head 44 connects to the common ground and the required DC value lead, and shorts the other two output leads. Preferably, the plug and receiving device for the power output port 46 and the plug head 44 is an RJ-14-type connecting system.

Also connected to the adapter circuit 22 is a switch that directs the adapter circuit 22 to translate a received DC or AC signal. It can be appreciated by one of ordinary skill in the art that the switch for determining whether the adapter circuit 22 translates AC or DC signals may be either mechanical or electrical. If this switch is an electrical switch, the received signals are analyzed to determine whether the signal source is AC or DC and would then direct the adapter circuit 22 to translate the determined voltage source accordingly. According to an embodiment of the present invention, the switch is mechanical as shown by button 40. Button 40 is located on plug 20 between plug prongs 34*a* and 34*b*. When button 40 is depressed, the adapter circuit 22 switches to translate received DC signals, otherwise, the circuit will default to translating AC signals. It can be appreciated by one of ordinary skill in the art, that other types of mechanical switching devices may be incorporated in the AC and DC converter 19 for setting the adapter circuit 22 to the proper signal translating mode.

Figure 2B:
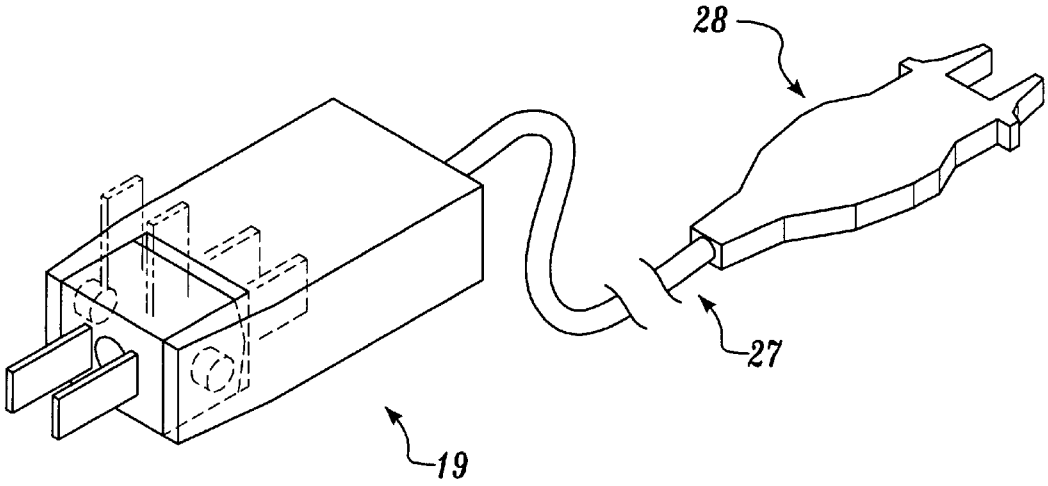

FIG. 2B illustrates an alternate embodiment of the present invention. As shown in FIG. 2B, the AC and DC converter 19 and the device-specific connecting piece 28 are attached without a plug/port mechanism at the ends of the power cord 27.

It can be appreciated by one of ordinary skill in the art that the adapter circuit 22 may be designed to receive and translate various input AC and DC voltage levels for producing a predefined output DC voltage. In one embodiment of the present invention, the adapter circuit 22 can operate with an input of 12 to 14 volts DC or an input AC voltage of 110 volts, the U.S. standard, or 220 volts, the European standard.

Figure 3:
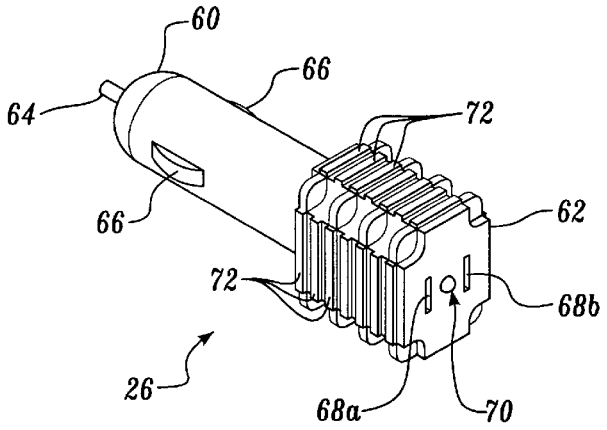
FIG. 3 is a perspective view of a lighter plug DC outlet.

As shown in FIG. 3, the lighter plug DC outlet 26 includes a lighter plug portion 60 and an outlet portion 62. The lighter plug portion 60 is sized to be received by a standard automobile or vessel cigarette lighter outlet. The lighter plug portion 60 includes a first contact 64 for connecting to the positive lead of a cigarette lighter outlet and at least one second contact 66 for connecting to the negative lead of a cigarette lighter outlet.

The outlet portion 62 is primarily cubic in shape and is attached at one end to the portion of the lighter plug portion 60 that would extend out of a cigarette lighter outlet when inserted. On the surface of the outlet portion 62 opposite the side connected to the lighter plug portion 60 are two prong receiving cavities 68*a* and 68*b*, and an LED 70 raised from the surface of the outlet portion 62 and located between the prong receiving cavities 68*a* and 68*b*. The prong receiving cavities 68*a* and 68*b* are sized and spaced similar to standard AC outlets. The circuitry within the outlet portion 62 is described in more detail below with respect to FIG. 4. The LED 70 is raised to a position for allowing activation of button 40 on the AC and DC plug 20, thus switching the adapter circuit 22 to translate DC input voltage signals when the prongs 34*a* and 34*b* are fully inserted into the prong receiving cavities 68*a* and 68*b*, respectively. Outlet portion 62 also includes gripping ridges 72 located on its outer longitudinal surfaces. The gripping ridges 72 allow for easy insertion and extraction of the lighter plug DC outlet 26.

Figure 4:
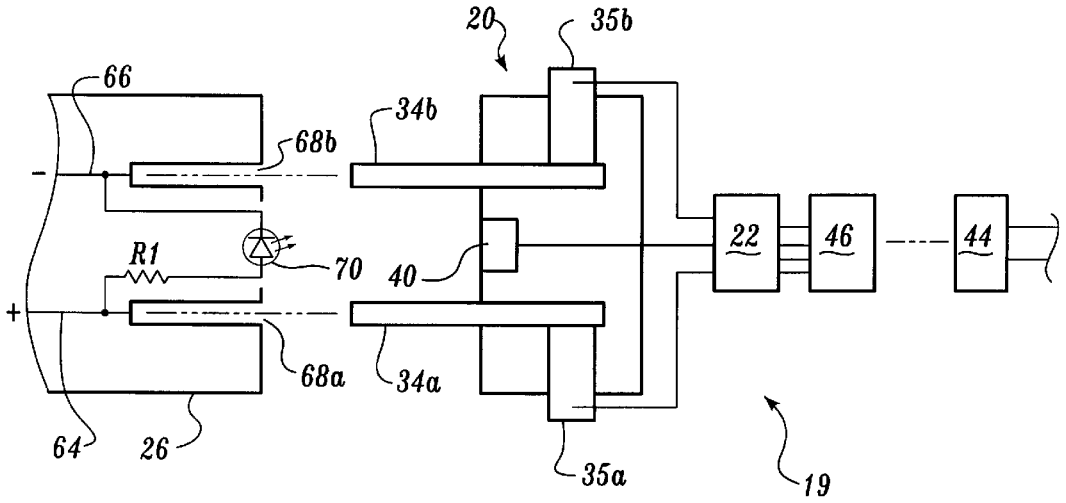
FIG. 4 is a partial circuit diagram of the connection made between the lighter plug DC outlet and the AC and DC plug.

FIG. 4 illustrates the basic internal circuitry of the lighter plug DC outlet 26 and the AC and DC plug 20. Within the lighter plug DC outlet 26, the positive lead 64 connects to prong receiving cavity 68*a* and to the input of LED 70 through resistor R1. Negative lead 66 connects to prong input cavity 68*b* and the output of LED 70. When the lighter plug DC outlet 26 is inserted into a cigarette lighter outlet, the prong cavities and the LED 70 are powered. It is preferable to leave the lighter plug DC outlet 26 in the cigarette lighter at all times, thereby always having a power source readily available. The LED 70 allows a user to easily find the outlet portion 62 at night, because the LED 70 is always eliminated when the lighter plug DC outlet 26 is fully inserted in a lighter outlet. In order to minimize vehicle battery power use, resister R1 is equal to 600 ohms, but may be varied according to the requirements of the LED 70 or other components in the system.

Still referring to FIG. 4, the prongs 34*a* and 34*b* of the AC and DC plug 20 connect to adapter circuit 22 through axles 35*a* and 35*b*, respectively. Also, button 40 connects to adapter circuit 22. The adapter circuit 22 supplies generated DC voltages to the output port 46 which receives plug head 44.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An adapter plug system connectable to AC and DC sources for powering electrically powered devices, said system comprising:

an adapter power cord for receiving AC or DC voltages into a predefined DC voltage for an electrically powered device, said adapter power cord further comprising:

an electrical cable with at least two wires;

an adapter circuit housed in a case that is attached to one end of the cable for translating the received AC or DC voltages into a DC voltage acceptable for the attached electrically powered device;

a plug comprising first and second prongs spaced apart from one another and generally parallel to each other, said plug being attached to the case, wherein said prongs are electrically coupled to the adapter circuit and insertable into an electrical power outlet for receiving a voltage;

a switch for setting the adapter circuit to translate received AC or DC voltages; and an electrically powered device-specific plug being attached to the other end of the cable and attachable to a specific electrically powered device; and a DC adapter with an outlet portion, wherein said outlet portion resembles a standard two-prong AC outlet with plug prong receiving ports and wherein the DC adapter is insertable into a vehicle lighter outlet for supplying a DC voltage to the adapter circuit when the plug prongs are inserted into the plug prong receiving ports.

2. The system of claim 1, wherein the switch further comprises a pressure sensitive button mounted between the first and second prongs of the plug; and wherein the DC adapter further comprises a pressure sensitive button activator located on the outlet portion between the plug prong receiving ports for activating the pressure sensitive button when the plug prongs are inserted into the plug prong receiving ports, when the pressure sensitive button is activated, the adapter circuit translates the received DC voltage to the DC voltage acceptable for the attached electrically powered device.

3. The system of claim 1, wherein the switch further comprises a AC/DC voltage determining circuit for automatically determining if the received voltage is an AC or DC voltage, and wherein the adapter circuit translates the received voltage based on the determination made by the AC/DC voltage determining circuit.

4. The system of claim 1, wherein the plug further comprises a plug prong housing for supporting the first and second prongs, said plug prong housing being rotatably connected to said case, wherein said plug prong housing is rotatable from a stowed position having the plug prong housing mounted flush with the case and the prongs recessed in the case, to a first extended position with said prongs projecting from the case, wherein said extended position is substantially orthogonal to said stowed position, and to a second extended position with said prongs projecting from the case, wherein said second extended position is substantially orthogonal to the stowed position and at least 180° different from the first extended position, said prongs being electrically connected to said adapter circuit at and all points between the stowed and second extended position, the total range of rotation of the plug prong housing is at least 270°.

5. An adapter plug system connectable to AC and DC sources for powering electrically powered devices, said system comprising:

an adapter power unit for receiving AC or DC voltages and generating a plurality of predefined DC voltages according to the received AC or DC voltages, said adapter power unit further comprising:

an adapter circuit housed in a case for generating a plurality of predefined DC voltages from the received AC or DC voltages, said case being attachable to an electrically powered device;

a plug comprising first and second prongs spaced apart from one another and generally parallel to each other, said plug being attached to the case, wherein said prongs are electrically coupled to the adapter circuit and insertable into an electrical power outlet for receiving a voltage;

a switch for setting the adapter circuit to translate received AC or DC voltages; and an output port with a plurality of leads coupled to the adapter circuit, wherein each of the generated plurality of DC voltages are assigned to a corresponding lead of the plurality of leads;

a DC adapter with an outlet portion, wherein said outlet portion resembles a standard two-prong AC outlet with plug prong receiving ports and wherein the DC adapter is insertable into a vehicle lighter outlet for supplying a DC voltage to the adapter circuit when the plug prongs are inserted into the plug prong receiving ports; and an electrically powered device-specific cord for coupling the adapter power unit to the electrically powered device, said electrically powered device-specific cord comprises a connecting cord with at least a two wires, an electrically powered device-specific plug at one end of the connecting cord and a wire plug at the other end of the connecting cord, wherein the wire plug is formed to be insertable into the output port of the adapter power unit.

6. The system of claim 5, wherein the switch further comprises a pressure sensitive button mounted between the first and second prongs of the plug; and wherein the DC adapter further comprises a pressure sensitive button activator located on the outlet portion between the plug prong receiving ports for activating the pressure sensitive button when the plug prongs are inserted into the plug prong receiving ports, when the pressure sensitive button is activated, the adapter circuit translates the received DC voltage to the DC voltage acceptable for the attached electrically powered device.

7. The system of claim 5, wherein the switch further comprises a AC/DC voltage determining circuit for automatically determining if the received voltage is an AC or DC voltage, and wherein the adapter circuit translates the received voltage based on the determination made by the AC/DC voltage determining circuit.

8. An adapter plug system connectable to AC and DC sources for powering electrically powered devices, said system comprising:

an adapter power cord for receiving and translating AC or DC voltages into a predefined DC voltage for an electrically powered device, said adapter power cord further comprising:

an electrical cable with at least two wires;

an adapter circuit housed in a case that is attached to one end of the cable for translating the received AC or DC voltages into a DC voltage acceptable for the attached electrically powered device;

a plug comprising first and second prongs spaced apart from one another and generally parallel to each other, said plug being attached to the case, electrically coupled to the adapter circuit and insertable into an electrical power outlet for receiving with AC or DC voltage;

a switch for setting the adapter circuit to translate received AC or DC voltages; and an electrically powered device-specific plug being attached to the other end of the cable and attachable to a specific electrically powered device.

9. An adapter plug system connectable to AC and DC sources for powering electrically powered devices, said system comprising:

an adapter power unit for receiving AC or DC voltages and generating a plurality of predefined DC voltages according to the received AC or DC voltages, said adapter power unit further comprising:

an adapter circuit housed in a case for generating a plurality of predefined DC voltages from the received AC or DC voltages, said case being attachable to an electrically powered device;

a plug comprising first and second prongs spaced apart from one another and generally parallel to each other, said plug being attached to the case, wherein said prongs are electrically coupled to the adapter circuit and insertable into an electrical power outlet for receiving a voltage;

a switch for setting the adapter circuit to translate received AC or DC voltages; and an output port with a plurality of leads coupled to the adapter circuit, wherein each of the generated plurality of DC voltages are assigned to a corresponding lead of the plurality of leads;

a DC adapter with an outlet portion, wherein said outlet portion resembles a standard two-prong AC outlet with plug prong receiving ports and wherein the DC adapter is insertable into a vehicle lighter outlet for supplying a DC voltage to the adapter circuit when the plug prongs are inserted into the plug prong receiving ports.

10. A DC adapter for allowing a vehicle lighter outlet to receive a two prong plug, said adapter comprising:

a lighter outlet portion being insertable into a vehicle lighter outlet for receiving a DC voltage from the vehicle lighter outlet; and an outlet portion coupled to the lighter outlet portion, wherein said outlet portion resembles a standard two-prong AC outlet with plug prong receiving ports though supplies a DC voltage.

* * * * *

UNITED STATES PATENT AND TRADEMARK OFFICE

CERTIFICATE OF CORRECTION

PATENT NO. : 6,057,610
DATED : May 2, 2000
INVENTOR(S) : D.S. Nierescher

It is certified that error appears in the above-identified patent and that said Letters Patent is hereby corrected as shown below:

| COLUMN | LINE | ERROR |
|---|---|---|
| 5 (Claim 1, | 19 line 4) | insert --and translating-- after "receiving" |

Signed and Sealed this

Tenth Day of April, 2001

*Attest:*

Nicholas P. Godici

NICHOLAS P. GODICI

*Attesting Officer*

*Acting Director of the United States Patent and Trademark Office*